US005477962A

United States Patent [19]

Kalamon

[11] Patent Number: 5,477,962

[45] Date of Patent: Dec. 26, 1995

[54] CONTAINER FOR SUPPORTING ROOFING MATERIAL AND RELATED TOOLS

[76] Inventor: William M. Kalamon, P.O. Box 143, Boyertown, Pa. 19512

[21] Appl. No.: 329,281

[22] Filed: Oct. 26, 1994

[51] Int. Cl.[6] ..... B65D 71/52

[52] U.S. Cl. ..... 206/322; 206/373

[58] Field of Search ..... 206/321, 322, 206/323, 324, 372, 373, 486, 488

[56] References Cited

U.S. PATENT DOCUMENTS 1,216,270 2/1917 Becker ..... 206/323

2,748,499 6/1956 Shater ..... 206/322 X 4,460,085 7/1984 Jantzen ..... 206/372 X 5,370,263 12/1994 Brown ..... 206/373 X

*Primary Examiner*—Jacob K. Ackun

[57] ABSTRACT

A container for supporting roofing material and related tools including a base plate formed of a rigid material having upper and lower edges and tapering side edges therebetween. One upstanding lower wall is coupled at its lower edge to the lower edge of the base plate and upstanding side walls extending upwardly from the side edges of the base plate from the lower edge to along the side edges.

8 Claims, 4 Drawing Sheets

CONTAINER FOR SUPPORTING ROOFING MATERIAL AND RELATED TOOLS

BACKGROUND OF THE INVENTION

1. Field of the Invention

The present invention relates to containers for supporting roofing material and related tools and more particularly pertains to supporting and maintaining a quantity of roofing tiles at a convenient location on a roof along with the necessary tools and components for installing such tiles.

2. Description of the Prior Art

The use of containers for tools and a wide variety of other objects is known in the prior art. More specifically, containers for tools and a wide variety of other objects heretofore devised and utilized for the purpose of maintaining tools for a particular work job at a specific location through a wide variety of containers of various designs and configurations are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 3,769,916 a roofing shingle dolly.

U.S. Pat. No. 5,244,221 discloses a type of multi-use hand truck.

U.S. Pat. No. Des. 278,373 discloses the design of a hand truck.

U.S. Pat. No. Des. 327,761 discloses the design of a hand truck.

U.S. Pat. No. Des. 333,543 discloses the design of a hand truck.

In this respect, the container for supporting roofing material and related tools according to the present invention substantially departs from the conventional concepts and designs of the prior art, and in doing so provides an apparatus primarily developed for the purpose of to support and maintain a quantity of roofing tiles at a convenient location on a roof along with the necessary tools and components for installing such tiles.

Therefore, it can be appreciated that there exists a continuing need for a new and improved container for supporting roofing material and related tools which can be used to support and maintain a quantity of roofing tiles at a convenient location on a roof along with the necessary tools and components for installing such tiles. In this regard, the present invention substantially fulfills this need.

SUMMARY OF THE INVENTION

In view of the foregoing disadvantages inherent in the known types of containers for tools and a wide variety of other objects now present in the prior art, the present invention provides an improved container for supporting roofing material and related tools. As such, the general purpose of the present invention, which will be described subsequently in greater detail, is to provide a new and improved container for supporting roofing material and related tools and method which has all the advantages of the prior art and none of the disadvantages.

To attain this, the present invention essentially comprises a new and improved container for supporting roofing material and related tools comprising, in combination: a base plate formed of a rigid material having a short upper edge, a long lower edge, and tapering side edges therebetween, the base plate having an upper surface and a lower surface; one upstanding lower wall coupled at its lower edge to the lower edge of the base plate and upstanding side walls extending upwardly from the side edges of the base plate from the lower edge to along the side edges to an intermediate extent thereof; an intermediate wall parallel with the lower wall and spaced therefrom and extending between the side walls to form a box therein for the receipt and support of tools; a tile zone on the upper surface of the base plate, the tile zone formed of a lower wall parallel with the intermediate wall but spaced therefrom and associated intermediate side walls extending forwardly from the lower bottom wall and an upper wall parallel with the lower wall to form a channel for the receipt of roofing tiles, the height of the walls being of the tile zone less than the height of the other walls; and a handle in an inverted U-shaped configuration with a longitudinal portion and parallel side portions extending rearwardly therefrom with apertures therethrough and attachment means to couple the handle to the side walls of the base plate adjacent to the upper edge, the side portions of the handle being parallel with the base plate adjacent thereto and then with a bend for projecting upwardly therefrom; a nonstick pad secured to the lower surface of the base plate with screws for the attachment therebetween; pockets formed on the exterior surface of at least one of the side walls for the supporting of tools; a removable container positionable within the box with apertures therethrough for the removable coupling therebetween; at least one dowel removably positioned within the container and extending upwardly therefrom for the support of tools; and a pair of wheels secured to an angled interface between the base plate and bottom surface to facilitate the rolling movement of the device.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved container for supporting roofing material and related tools which has all the advantages of the prior art containers for tools and a wide variety of other objects and none of the disadvantages.

It is another object of the present invention to provide a new and improved container for supporting roofing material and related tools which may be easily and efficiently manufactured and marketed.

It is further object of the present invention to provide a new and improved container for supporting roofing material and related tools which are of durable and reliable constructions.

An even further object of the present invention is to provide a new and improved container for supporting roofing material and related tools which is susceptible of a low cost of manufacture with regard to both materials and labor, and which accordingly is then susceptible of low prices of sale to the consuming public, thereby making such container for supporting roofing material and related tools economically available to the buying public.

Still yet another object of the present invention is to provide a new and improved container for supporting roofing material and related tools which provide in the apparatuses and methods of the prior art some of the advantages thereof, while simultaneously overcoming some of the disadvantages normally associated therewith.

Still another object of the present invention is to support and maintain a quantity of roofing tiles at a convenient location on a roof along with the necessary tools and components for installing such tiles.

Lastly, it is an object of the present invention to provide a new and improved container for supporting roofing material and related tools comprising a base plate formed of a rigid material having a short upper edge, a long lower edge, and tapering side edges therebetween, the base plate having an upper surface and a lower surface;

one upstanding lower wall coupled at its lower edge to the lower edge of the base plate and upstanding side walls extending upwardly from the side edges of the base plate from the lower edge to along the side edges to an intermediate extent thereof;

an intermediate wall parallel with the lower wall and spaced therefrom and extending between the side walls to form a box therein for the receipt and support of tools;

a tile zone on the upper surface of the base plate, the tile zone formed of a lower wall parallel with the intermediate wall but spaced therefrom and associated intermediate side walls extending forwardly from the lower bottom wall and an upper wall parallel with the lower wall to form a channel for the receipt of roofing tiles, the height of the walls being of the tile zone less than the height of the other walls; and a handle in an inverted U-shaped configuration with a longitudinal portion and parallel side portions extending rearwardly therefrom with apertures therethrough and attachment means to couple the handle to the side walls of the base plate adjacent to the upper edge, the side portions of the handle being parallel with the base plate adjacent thereto and then with a bend for projecting upwardly therefrom.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
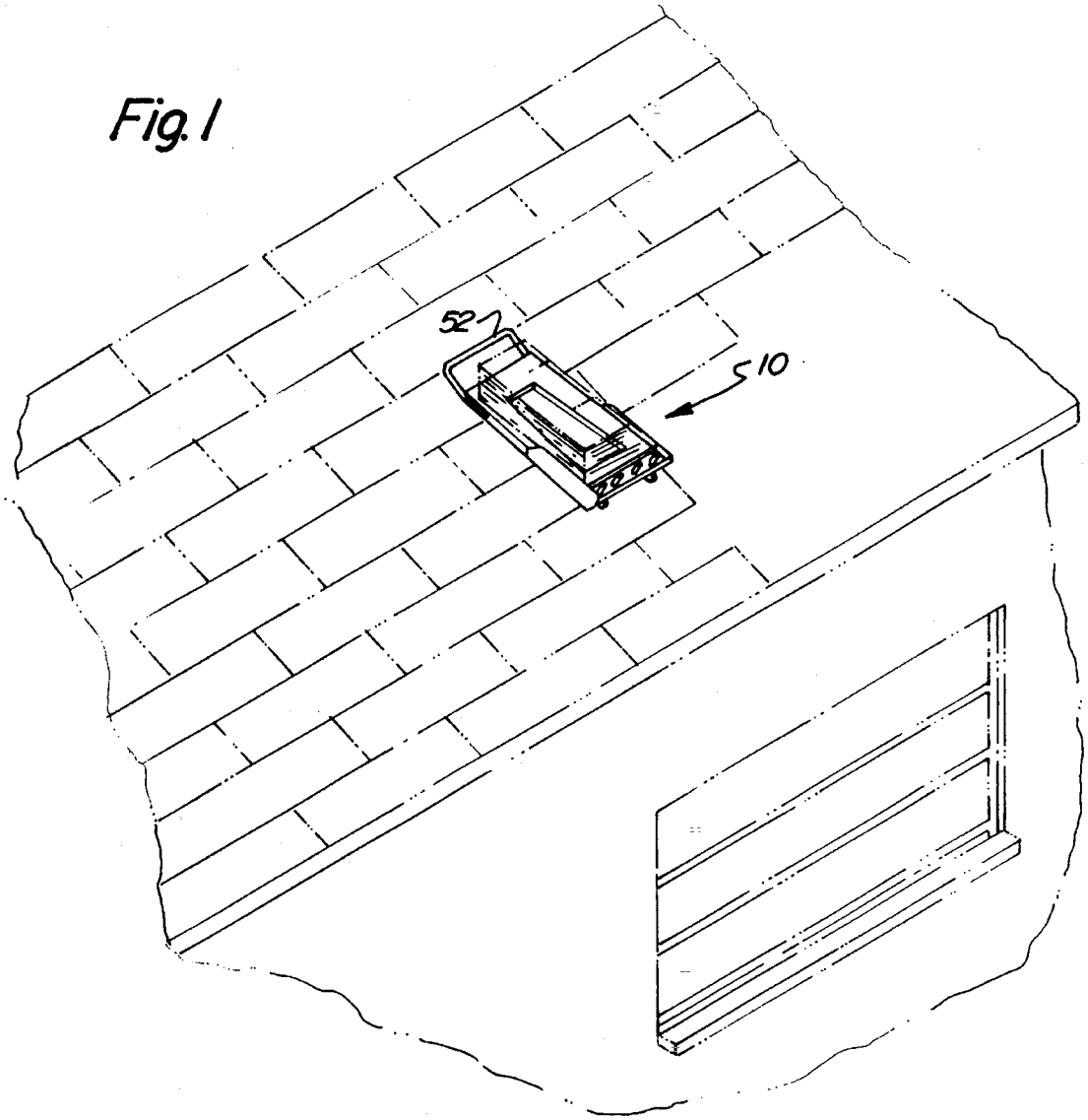
FIG. 1 is a perspective view of the preferred embodiment of the new and improved container for supporting roofing material and related tools constructed in accordance with the principles of the present invention.
Figure 2:
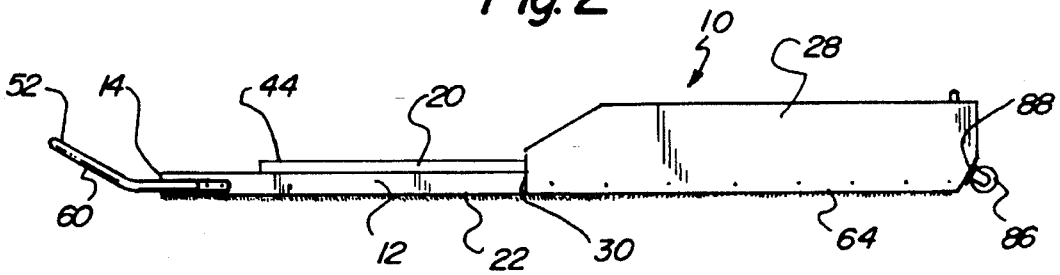
FIG. 2 is a side elevational view of the device shown in FIG. 1.
Figure 4:
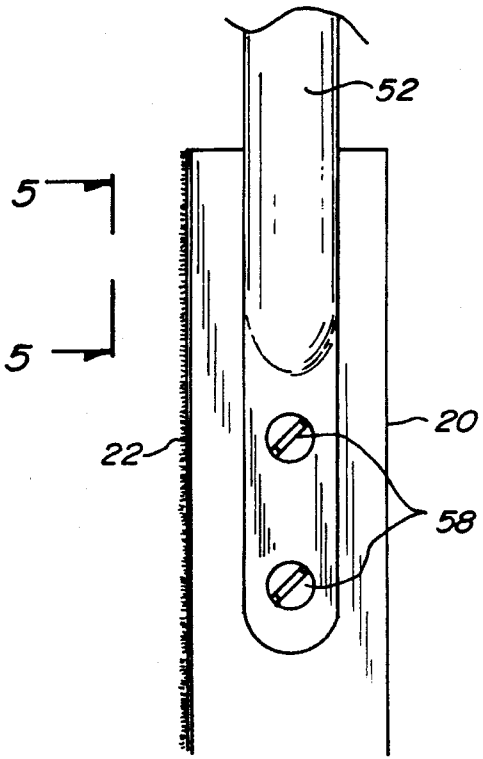
FIG. 4 is a side elevational view of the coupling of the container and handle of the device shown in the prior Figures.
Figure 3:
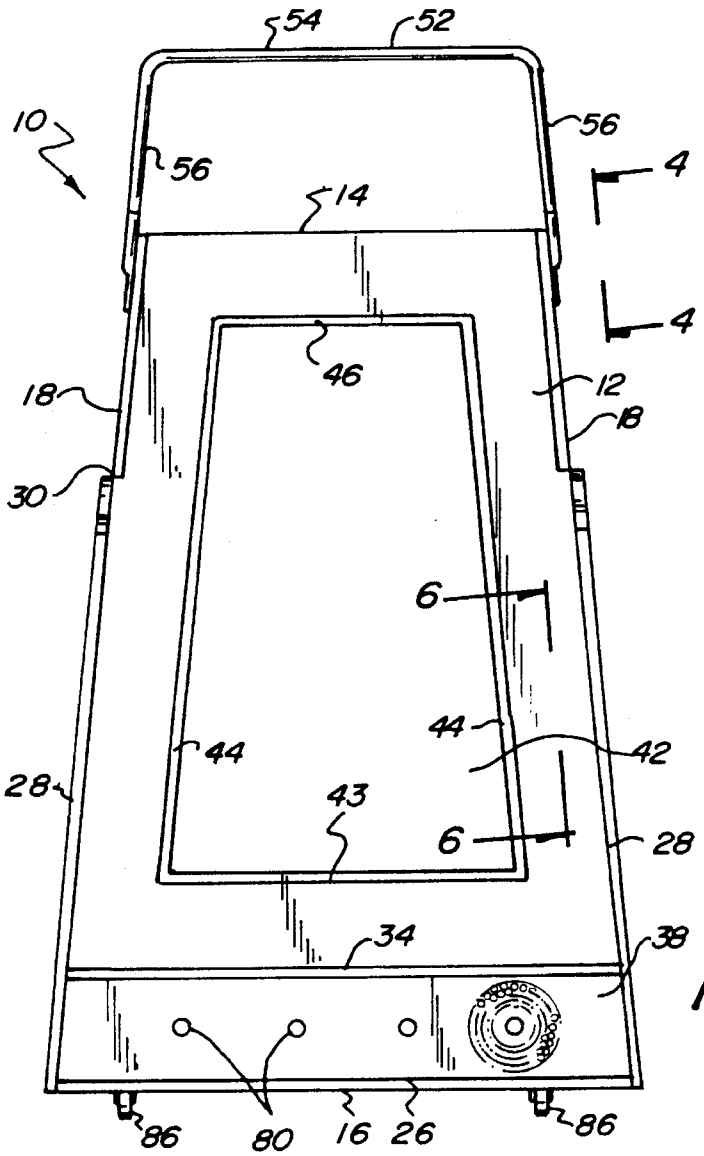
FIG. 3 is a plan view of the device shown in FIGS. 1 and 2.
Figure 5:
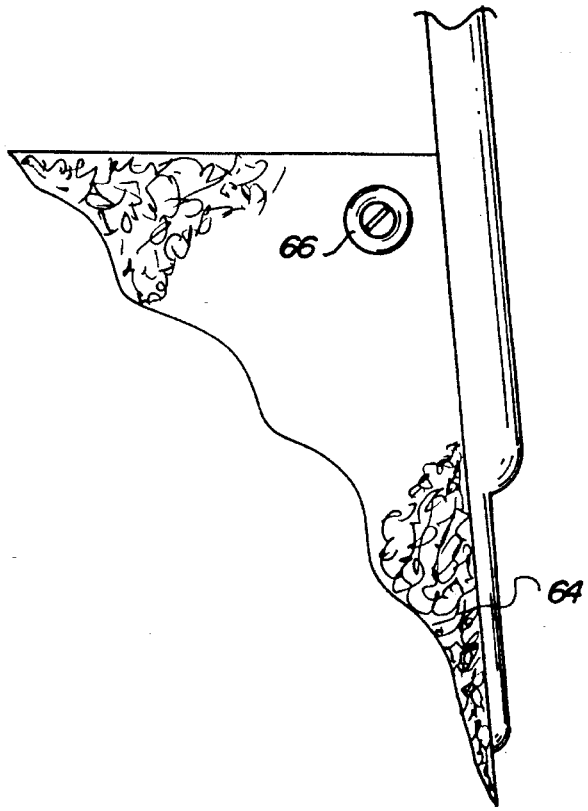
FIG. 5 is an enlarged bottom view of one corner of the device shown in FIG. 4.
Figure 6:
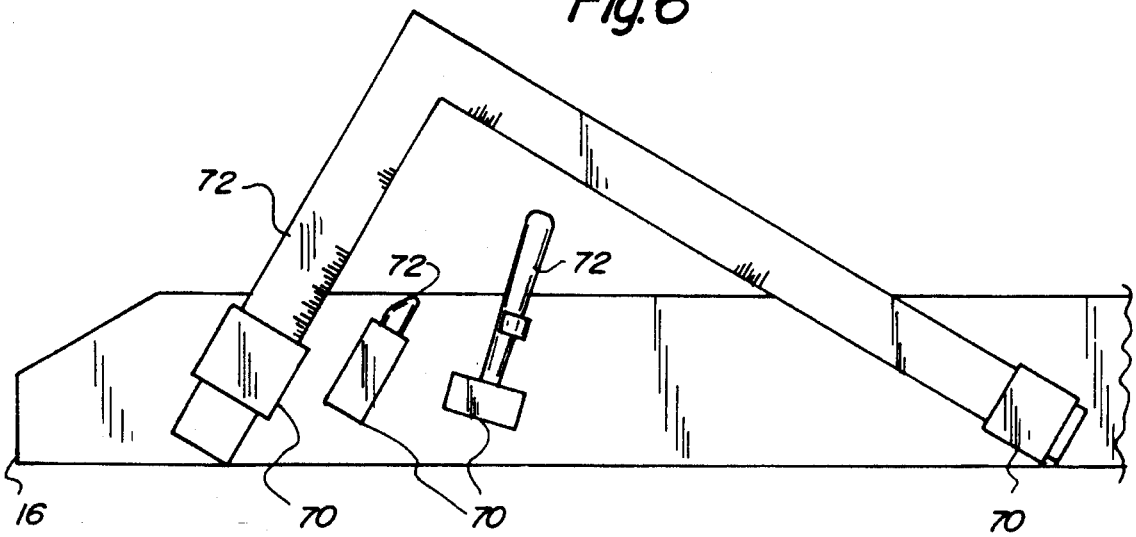
FIG. 6 is a side elevational view of pockets on one side of the device of the prior Figure with representative tools therein.

With reference now to the drawings, and in particular to FIG. 1 thereof, the preferred embodiment of the new and improved container for supporting roofing material and related tools embodying the principles and concepts of the present invention and generally designated by the reference numeral 10 will be described.

The present invention, the new and improved container for supporting roofing material and related tools for comprised of a plurality of components. Such components comprise a base plate, upstanding wall, intermediate wall, tile zone, handle, non-stick pad, pockets, removable container, dowels, divider insert and wheels. Such components are individually configured and correlated with respect to each other so as to attain the desired objective.

The central component of the system 10 is a base plate 12. The base plate is fabricated of a rigid material. It has a short upper edge 14, a long lower edge 16, and tapering side edges 18 therebetween. The base plate has an upper surface 20 and a lower surface 22.

Formed with respect to the base is one upstanding lower wall 26 coupled at its lower edge to the lower edge of the base plate. In association therewith, upstanding side walls 28 extend upwardly from the side edges of the base plate. They extend from the lower to along the side edges to an intermediate extent 30 thereof.

Next provided is an intermediate wall 34. The intermediate wall is parallel with the lower wall. It is spaced therefrom to define a region therebetween. It extends between the side walls and thus forms a box 38 therein. Such box is for the receipt and support of tools.

At a higher location from the intermediate wall and spaced therefrom is a tile zone 42. The tile zone is located on the upper surface of the base plate. The tile zone is formed with a lower wall, 43 parallel with and spaced from the intermediate wall. In addition, associated intermediate side walls 44 extend forwardly from the lower bottom wall. Lastly, an upper wall 46 is parallel with the lower wall 43. Together these walls form a channel for the receipt of roofing tiles. The height of the walls of the tile zone is less than the height of the other walls secured to the periphery of the base.

In order to facilitate the handling of the base plate and components secured thereto in the system 10 of the present invention, there is provided a handle 52. The handle is in an inverted U-shaped configuration with a longitudinal portion 54 and parallel side portions 56 extending rearwardly from the longitudinal portion. Apertures are formed through the ends of the side portions at the upper end of the side edges of the base plate. Attachment members in the form of screws 58 are used to couple the handle to the side walls of the base plate adjacent to the upper edge. The side portions of the handle are parallel to the side plate adjacent thereto. The side portions are then formed with bends 60 for projecting at an angle upwardly therefrom.

Extended utility and safety is provided to the system 10 of the present invention through the use of a pad 64. The pad is of a non-stick material. It is secured to the lower surface of the base plate. Screws 66 effect such coupling between the base plate and the pad.

Formed on the exterior surface of at least one of the side walls are a plurality of pockets 70. The pockets are formed of a variety of sizes and shapes for the removable supporting of a wide variety of tools 72 in a position for easy access by a user when utilizing the system 10 of the invention.

Even further utility is provided to the system 10 of the present invention by the use of a removable container 76. The container is of a box-like rectangular configuration. It is positionable when in the box at the lower end of the base plate. Apertures extend through the container to couple it to the box for the removable coupling therebetween.

In order to hold cylindrical and roll-type items within the box, there is provided at least one dowel 80. Such dowel or any number of dowels are removably positioned with their lower ends 82 removably attached to the container on their upper surface. The dowels extend upwardly therefrom for the support of various items.

The last component of the system is a pair of wheels 86. The wheels are preferably secured to an angle interface 88. Such interface is located between the base plate and the bottom surface. The wheels facilitate the easy rolling movement of the base plate and associated portions thereof during operation and use.

Figure 8:
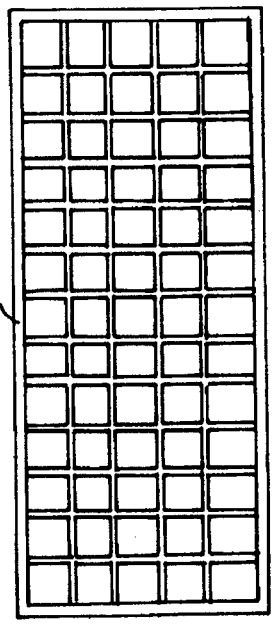
FIG. 8 is a top elevational view of another alternate embodiment of the invention.
Figure 7:
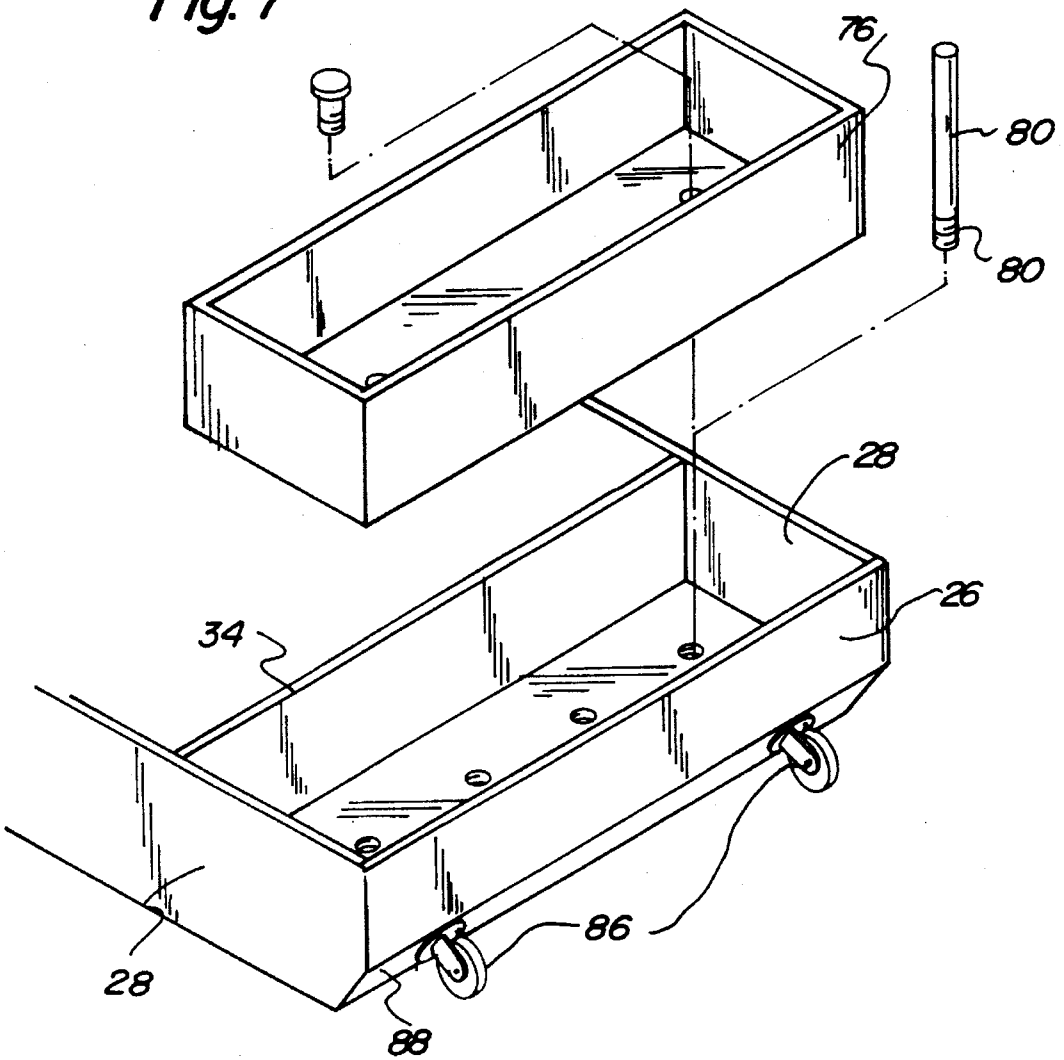
FIG. 7 is an exploded perspective view of one alternate embodiment of the invention.

In an alternate embodiment of the invention, as shown for example in FIG. 8, a divider insert 90 is provided. The divider insert is formed of a plurality of vertical strips and horizontal strips in a grid-like configuration. Such strips form a plurality of small zones for the receipt and support of components to be used when utilizing the system of the present invention. The divider insert is preferably located within the container during operation and use.

Applying asphalt shingles to a roof is a difficult and dangerous job. The shingles are supplied in bundles that weighty up to 90 pounds, and are applied individually by nailing or stapling them to a wood roof over a waterproof tar paper or felt under layer. Chalk lining has made shingle alignment easier and faster, resulting in a faster and better looking job. Pneumatic coil nailers and staplers have reduced the time needed to apply shingles. Booms and conveyors have made it much easier and faster to lift bundles of shingles up and stack them on the ridge. Yet making shingles available to a roofer on slopes of 5/12 or greater is very difficult as the bundles and loose shingles tend to slip and slide off the roof. The present invention efficiently alleviates the problem of making materials available to a roofer. It is a roofing materials handling device that enables a worker to easily apply a large number of shingles on steep roofs. It holds shingles, tools, and hardware, enabling easy, safe and efficient movement of supplies wherever needed.

The present invention can hold over a full bundle of 30 year fiberglass shingles plus a hammer, corner square, utility knife, and a large number of nails. It increases efficiency by keeping shingles close to where they will be used along with everything needed to install them. The present invention is easily moved to new places without damaging previously laid shingles, and will stay pin place without slipping on slopes of. Should a user slip while moving the present invention, dropping it quickly stops it from sliding further.

The present invention is made of wood or vacuum formed plastic, with a polyester anti-slip coating, an iron handle, and rubber and iron casters. It has a trapezoidal base that is about 12 inches wide at the top, 16 inches wide at the bottom, and 30 inches long. A round iron handle is fastened about 4 inches about the top at an angle of about 30 degrees by two iron straps. Two side pieces about 4 inches high are attached to the lower half, extending about 4 inches past the bottom. The front of the side pieces slants downward at a 45 degree angle, and the back slants up at a 60 degree angle for about 3". An end piece is attached across the end of the base and between the side pieces to hold the shingles. Another end piece is attached to the ends of the side pieces, and the space between the end pieces is filled by a support piece. The support piece may have four dowels equally space don its centerline to hold coils of pneumatic nails. Two 2" diameter rubber casters are fastened to the bottom of the support piece such that their wheels are just below the bottom surface of the base. The entire bottom of the base is covered with a piece of short pile polyester carpeting to provide an anti-slip surface.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved container for supporting roofing material and related tools comprising, in combination:

a base plate formed of a rigid material having a short upper edge, a long lower edge, and tapering side edges therebetween, the base plate having an upper surface and a lower surface;

one upstanding lower wall coupled at its lower edge to the lower edge of the base plate and upstanding side walls extending upwardly from the side edges of the base plate from the lower edge to along the side edges to an intermediate extent thereof;

an intermediate wall parallel with the lower wall and spaced therefrom and extending between the side walls to form a box therein for the receipt and support of tools;

a tile zone on the upper surface of the base plate, the tile zone formed of a lower wall parallel with the intermediate wall but spaced therefrom and associated intermediate side walls extending forwardly from the lower bottom wall and an upper wall parallel with the lower wall to form a channel for the receipt of roofing tiles, the height of the walls being of the tile zone less than the height of the other walls; and a handle in an inverted U-shaped configuration with a longitudinal portion and parallel side portions extending rearwardly therefrom with apertures therethrough and attachment means to couple the handle to the side walls of the base plate adjacent to the upper edge, the side portions of the handle being parallel with the base plate adjacent thereto and then with a bend for projecting upwardly therefrom;

a nonstick pad secured to the lower surface of the base plate with screws for the attachment therebetween;

pockets formed on the exterior surface of at least one of the side walls for the supporting of tools;

a removable container positionable within the box with apertures therethrough for the removable coupling therebetween;

at least one dowel removably positioned within the container and extending upwardly therefrom for the support of tools; and a pair of wheels secured to an angled interface between the base plate and bottom surface to facilitate the rolling movement of the device.

2. A container for supporting roofing material and related tools comprising: combination:

a base plate formed of a rigid material having a short upper edge, a long lower edge, and tapering side edges therebetween, the base plate having an upper surface and a lower surface;

one upstanding lower wall coupled at its lower edge to the lower edge of the base plate and upstanding side walls extending upwardly from the side edges of the base plate from the lower edge to along the side edges to an intermediate extent thereof;

an intermediate wall parallel with the lower wall and spaced therefrom and extending between the side walls to form a box therein for the receipt and support of tools;

a tile zone on the upper surface of the base plate, the tile zone formed of a lower wall parallel with the intermediate wall but spaced therefrom and associated intermediate side walls extending forwardly from the lower bottom wall and an upper wall parallel with the lower wall to form a channel for the receipt of roofing tiles, the height of the walls being of the tile zone less than the height of the other walls; and a handle in an inverted U-shaped configuration with a longitudinal portion and parallel side portions extending rearwardly therefrom with apertures therethrough and attachment means to couple the handle to the side walls of the base plate adjacent to the upper edge, the side portions of the handle being parallel with the base plate adjacent thereto and then with a bend for projecting upwardly therefrom.

3. The device as set forth in claim 2 and further including a nonstick pad secured to the lower surface of the base plate with screws for the attachment therebetween.

4. The device as set forth in claim 2 and further including pockets formed on the exterior surface of at least one of the exterior side walls for the supporting of tools.

5. The device as set forth in claim 2 and further including a removable box positionable within the box with apertures therethrough for the removable coupling therebetween.

6. The device as set forth in claim 2 and further including at least one dowel removably positioned within the box and extending upwardly therefrom for the support of tools.

7. The device as set forth in claim 2 and further including a divider insert formed of a plurality of vertically and horizontally disposed strips in a grid configuration positionable within the box for the receipt and support of associated tools and related components.

8. The device as set forth in claim 2 and further including a pair of wheels secured to an angled interface between the face plate and bottom wall to facilitate the rolling movement of the container.

* * * * *